US005430223A

United States Patent [19]

Bauer

[11] Patent Number: 5,430,223

[45] Date of Patent: Jul. 4, 1995

[54] PROCESS FOR SEPARATING HIGHER HYDROCARBONS FROM A GAS MIXTURE

[75] Inventor: Heinz Bauer, Munich, Germany

[73] Assignee: Linde Aktiengesellschaft, Wiesbaden, Germany

[21] Appl. No.: 196,097

[22] PCT Filed: Aug. 13, 1992

[86] PCT No.: PCT/EP92/01857

§ 371 Date: Feb. 18, 1994

§ 102(e) Date: Feb. 18, 1994

[87] PCT Pub. No.: WO93/04327

PCT Pub. Date: Mar. 4, 1993

[30] Foreign Application Priority Data

Aug. 19, 1991 [DE] Germany ..... 41 27 406.7

[51] Int. Cl.[6] ..... C07C 7/00; F25J 3/02

[52] U.S. Cl. ..... 585/800; 62/24; 62/32; 62/34

[58] Field of Search ..... 585/800; 62/24, 32, 62/34

[56] References Cited

U.S. PATENT DOCUMENTS 4,455,158 6/1984 Vines et al. ..... 62/28
4,501,600 2/1985 Pahade ..... 62/28
4,608,068 8/1986 Bauer et al. ..... 62/18
4,714,487 12/1987 Rowles ..... 62/24

OTHER PUBLICATIONS

Förg et al., "Natural-Gas Liquefaction," *Linde Reports on Science and Technology*, 15/1970, pp. 27–40.

*Primary Examiner*—Anthony McFarland
*Assistant Examiner*—Nhat D. Phan
*Attorney, Agent, or Firm*—Millen, White, Zelano & Branigan

[57] ABSTRACT

A process for separating higher hydrocarbons from a gas mixture containing the latter and lower-boiling components by rectificatory decomposition is described. The feed gas mixture (6) is partially condensed (7) and fed to a separation column (9). A bottom fraction (27), rich in higher hydrocarbons, is removed from the bottom of the separation column (9), and a top fraction (10), rich in lower-boiling components, is removed from the top of the separation column. The top fraction (10) is partially condensed (11) and the resultant condensate is used as reflux for the separation column (9).

Both the partial condensation of the feed gas mixture and the partial condensation of the top fraction are produced by indirect heat exchange (7, 11) with a refrigerant, which consists of several components and is conveyed in an external circuit (18).

31 Claims, 2 Drawing Sheets

PROCESS FOR SEPARATING HIGHER HYDROCARBONS FROM A GAS MIXTURE

SUMMARY OF THE INVENTION

The invention relates to a process for separating higher hydrocarbons from a gas mixture containing the latter and lower-boiling components by rectification, in which process the gas mixture is partially condensed and fed to a separation column, at whose bottom a fraction rich in higher hydrocarbons and at whose top a fraction rich in lower-boiling components are drawn off; in this case the top fraction is partially condensed, and the condensate is fed to the top of the separation column as reflux.

Such a process is known from EP-B-0 318 504. In the known process, the cold required to condense the feed gas and top fraction is made available, on the one hand, by one or more refrigeration circuits and, on the other, by active pressure reduction of the feed gas or residual gas. The refrigeration circuits work at constant evaporation temperature and, with heat exchange with a condensing feed gas or top gas mixture, cause relatively large temperature differences and thus energy losses. The turbines used to generate the extreme cold are not suitable for all processes. In particular, in the case of temperature fluctuations, for example, they exhibit high wear because of unsteady process conditions. The previously known process, therefore, does not work completely satisfactorily in economic terms and operates reliably only if certain boundary conditions are observed.

The object of the invention is to provide a process of the initially mentioned type which works more economically, can be used more flexibly with respect to boundary conditions and, in particular, is also suited for relatively widely fluctuating parameters of the gas mixture to be separated.

This object is achieved by having the condensation of the gas mixture and the condensation the top fraction be produced by indirect heat exchange with a refrigerant, which consists of several components and is conveyed in an external circuit.

Structuring the process in this way makes it possible to variable match the refrigerant temperature to the requirements imposed by the composition of the feed gas and products. Compared to a refrigerant cascade, for example, this makes both low equipment costs and low energy losses possible. Also, extreme cold can be generated at reasonable expense, so that the process of the invention does not require a pressure-reduction turbine. The drawbacks associated with turbines with respect to flexibility are thus avoided.

The energy advantages of the process of the invention are surprisingly great. Not only compensate for extra costs caused by the multicomponent-refrigerant circuit, but overall produce a clear increase in the economic efficiency of the process. In addition, the possible applications of the process are extraordinarily flexible.

The separation column used in the process is generally only operated as an enrichment column, i.e., the partially condensed gas mixture is fed to the lower area of the column.

To improve the rectifying action of the separation column even further, it is advantageous to remove an intermediate fraction from the separation column at an intermediate point. The intermediate friction is at least partially condensed in indirect heat exchange with the refrigerant and is returned to the separation column.

This heat exchange occurs at a temperature that lies between the temperature level of the condensation of the feed gas mixture and that of the condensation of the top fraction. The corresponding heat exchangers are preferably connected in series on the refrigerant side, so that optimum use of the sliding evaporation temperature curve of the multicomponent refrigerant is produced. As a result, the process can be operated especially advantageously with respect to energy. Of course, it is also possible and in many cases also advantageous to remove several such intermediate fractions in an analogous way and to feed them to an indirect heat exchange with the refrigerant.

In the process of the invention, it is further advantageous to separate compressed refrigerant inside the external refrigeration circuit into a gaseous fraction and a liquid fraction. The gaseous fraction is cooled in indirect heat exchange with the portion that remains gaseous during the condensation of the top fraction and in this connection is condensed and then conveyed for indirect heat exchange with the top fraction.

After compression, the refrigerant that remains gaseous is thus used in an especially advantageous way to transmit extreme cold to the top fraction of the separation column. This further improves the energy balance of the process.

In the heat exchange with the portion of the top fraction that remains gaseous, the refrigerant is preferably not only completely condensed, but also supercooled, so as to have available, after pressure reduction the largest possible portion in the liquid state. After compression, the refrigerant that remains liquid is also supercooled as much as possible.

Downstream from the heat exchanger, the entire refrigerant stream can be recombined to produce reflux. After the heat exchange with the top fraction, the refrigerant, generally supplemented by the refrigerant fraction that remains liquid after compression, is brought into heat exchange with the gas mixture to be separated and first, if necessary, brought into heat exchange with the intermediate fraction.

According to a further development of the inventive idea, the process is carried out with a time-variable throughput and/or time-variable composition of the gas mixture to be separated.

Of course, each process is subject to time fluctuations, for example, when a unit is started and stopped. But, this further development pertains to changes with significantly shorter periods, in general shorter than one hour, preferably in the minute range, which exhibit, for example, temperature fluctuations of about 3 K/min and/or 10% changes in load per minute. Such deviations from steady-state behavior can also be caused by preceding process steps. For example, if the gas mixture to be separated in this process comes from a periodically operated apparatus, e.g., reversible reactors. In particular, if such preconditions exist, a process with generation of extreme cold by turbines (e.g., according to EP-B-0 318 504) would lead to very high wear of the turbines and thus would often experience shutdowns and high costs for the unit, in particular due to production loss. The process of the invention can, however, tolerate such fluctuations, since the multicomponent-refrigerant circuit used is not subject to any such wear phenomena and, like the previously known processes, various cold temperature levels can still be made available.

In the event that the process is carried out in such a unsteady way with relatively short periods, conventional regulating processes are often pushed to their limits since they react too sluggishly. According to a further development of the process of the invention, it is therefore provided that the throughput and/or the composition of the gas mixture to be separated is measured and the throughput of the refrigerant is adjusted to the various condensation stages on the basis of this measured value.

The necessary adaptations to the cold balance are thus performed not by adjustment but by control. In this connection, certain parameters, which can be determined in advance only partially by theoretical considerations, must enter into the calculation of the regulated quantities. Moreover, experimental values are necessary, which must be found the first time a unit is started up by operating personnel. Since the throughput and/or composition fluctuations of the gas mixture to be separated are generally periodic, these values can be found by testing and then firmly specified. Self-regulating units that optimize such parameters automatically as well as during continuous operation are also conceivable.

In the case of relatively short-term fluctuations of the compositions of the feed, intermediate-product and product streams, which are caused either indirectly, by throughputs of varying levels, or directly by the feed gas that builds up accordingly, another problem arises with the previously known processes of this kind. As a rule, the aluminum-plate heat exchangers usually used withstand the resulting frequent and short-term temperature fluctuations and the thus induced mechanical stresses for only a very short time. Also, coiled heat exchangers with aluminum pipes, whose design is better suited for compensating for thermal longitudinal deformations, can become leaky over time.

According to another aspect of the invention, heat exchangers made of a material with high long-term stability against mechanical stresses are, therefore, preferably used for indirect heat exchange between the top fraction and the refrigerant. In this connection, high-grade steel is preferably used. An embodiment of the heat exchanger in a coiled type of structure, i.e., with pipes arranged helically on concentric cylinder surfaces, is advantageous.

Similarly, it is advantageous for the indirect heat exchange between the portion that remains gaseous during the condensation of the top fraction and the gaseous fraction of the refrigerant and/or for indirect heat exchange (7) between gas mixture (6) to be separated and the refrigerant and/or for indirect heat exchange (24) between intermediate fraction (28) and the refrigerant each to use a heat exchanger, which is made of a material with high long-term stability against mechanical stresses.

According to a variant of the invention, a plate heat exchanger, especially an aluminum-plate heat exchanger, can be used for indirect heat exchange (7) between the gas mixture (6) to be separated and the refrigerant.

Figure 1:
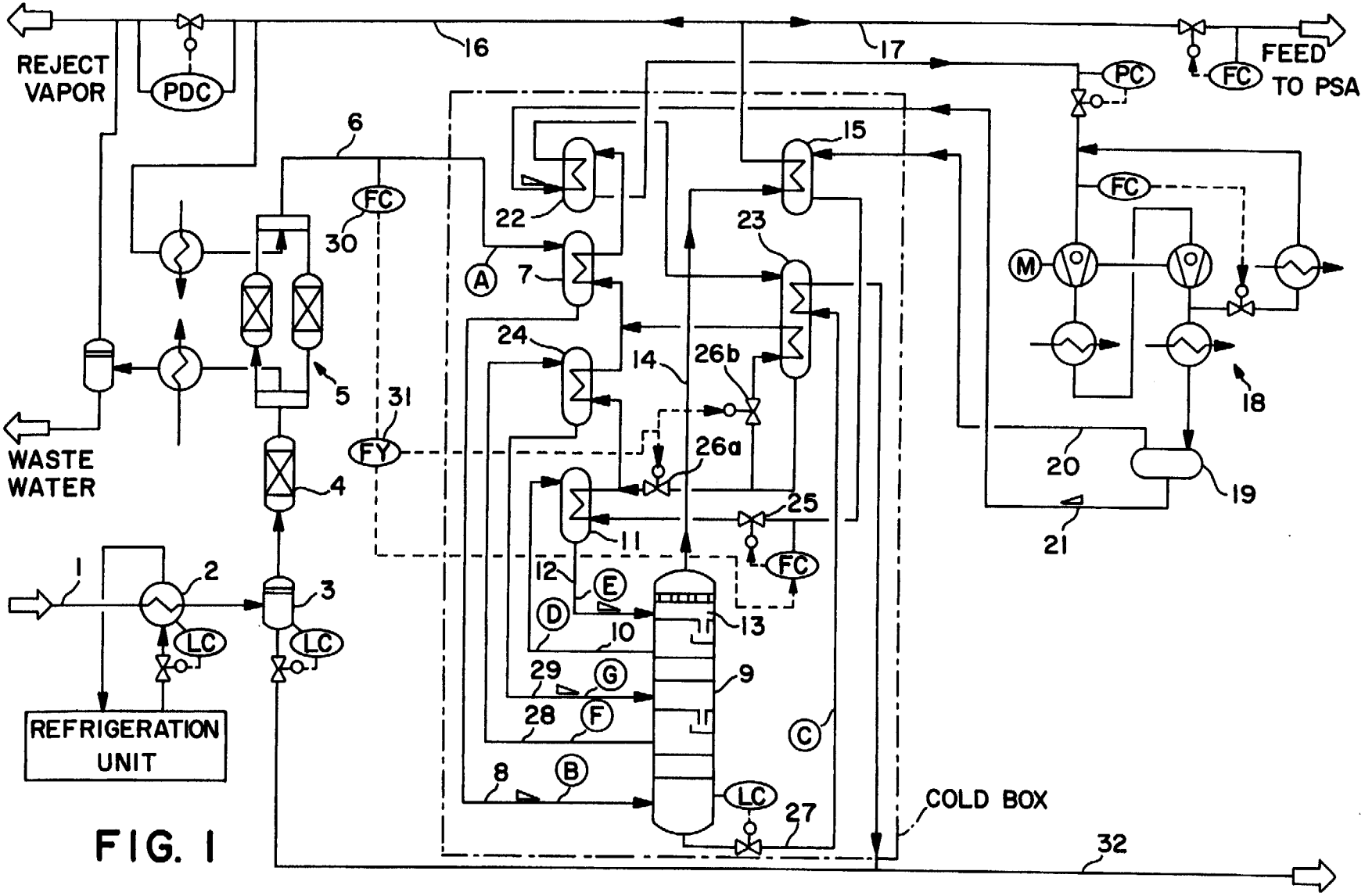
FIGS. 1 and 2 illustrate embodiments of the process according to the invention.
Figure 2:
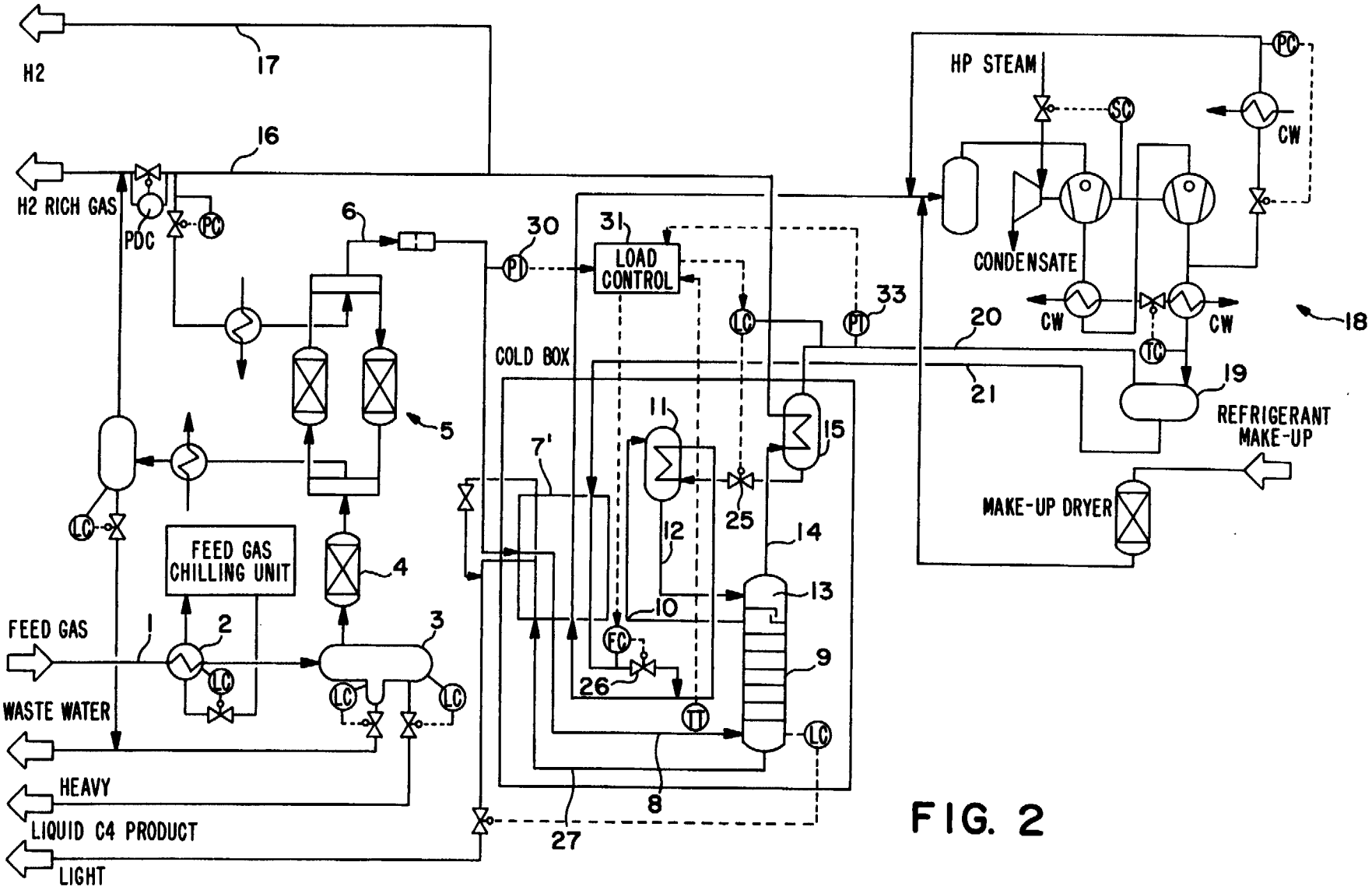

The invention as well as other details of the invention are now explained in more detail based on two embodiments, which are depicted in FIGS. 1 and 2 as procedural diagrams. They relate to a use of the process of the invention, in which its advantages are especially effective, namely the preparation of a product gas from a $C_3$ or $C_4$ dehydration. Such a gas contains, in addition to the higher hydrocarbons, more volatile portions, mainly hydrogen, but also smaller portions of water, carbon monoxide, carbon dioxide, nitrogen, $C_2$ hydrocarbons, etc. The process steps of the invention are used to separate the undesired lighter components, which is required for further processing of the $C_3$ or $C_4$ components.

DETAILED DESCRIPTION OF THE DRAWINGS

In the process of FIG. 1, the dehydration product gas is brought in via line 1 and first subjected to pretreatment. After cooling by means of an external refrigerating unit in a heat exchanger 2 and subsequent phase separation in a separator 3, chlorine traces are removed in an HCl reactor 4 from the portion that remains gaseous, and this portion is dried (5). The prepurified gas in line 6 now represents the gas mixture to be separated for the process of the invention and is also designated here as feed gas. It contains, for example, 30 to 70% of the more volatile components, which are to be separated. (The percentages relate here and below basically to the molar portions.)

The feed gas in line 6 is cooled in heat exchanger 7, partially condensed (to 5 to 40%, preferably 10 to 30%) and fed via line 8 above the bottom into a separation column 9. At the bottom of the separation column, the desired higher hydrocarbons accumulate as a bottom product, are drawn off via line 27 and heated in heat exchanger 23. Together with the higher-boiling components already condensed out during pretreatment from separator 3, they are fed via line 32 for further treatment, for example, to a depropanizer.

Line 10 conveys the top fraction of the separation column to a heat exchanger 11, in which the fraction is partially condensed. The two-phase mixture is conveyed via line 12 to a separator 13, which is integrated into the separation column. However, a phase separation device made as a separate component could also be used. The liquid from the separator flows as reflux into the separation column; the portion of the top fraction that remains gaseous is removed via a residual gas line 14 and heated in heat exchanger 15 to approximately ambient temperature. This gas can be fed partially or completely via line 17 to a compressor unit and then to another preparation step, for example, pressure-swing adsorption. As an alternative or in parallel to this, residual gas either is removed via line 16 and used, for example, as combustible gas or to regenerate dryer 5.

According to the invention, the cold required for feed gas condensation (heat exchanger 7) and top fraction condensation (heat exchanger 11) is generated by a multicomponent-refrigerant circuit 18 in which, in a known way, a refrigerant is compressed and partially liquefied. The refrigerant contains, for example, $C_2H_4$, $C_2H_6$, Iso-$C_4H_{10}$ and some $CH_4$. The exact composition is determined based on the plots of the respective evaporation curves. Here, exact matching to the evaporation properties of feed and intermediate product streams in their respective special compositions is possible.

Compressed refrigerant is introduced as a two-phase mixture to a refrigerant separator 19. The gaseous portion (line 20) is condensed to recover extreme coldness in indirect heat exchange 15 with portion 14 of the top fraction that remains gaseous and supercooled. The temperature of the refrigerant stream should be as low as possible, so that also with subsequent pressure reduction in flow-control valve 25, all refrigerant remains liquid. As a result, with subsequent heat exchange 11 with top fraction 10, a maximum amount of latent heat can be converted.

Portion 21 of the refrigerant that remains liquid from refrigerant separator 19 is also supercooled, namely in heat exchanger 22 against refrigerant under low pressure and in heat exchanger 23 against $C_{3+}/C_{4+}$ product stream 27 from the bottom of separation column 9 and again against low-pressure refrigerant. A first part of supercooled liquid is subjected to pressure reduction in flow-control valve 26*a*, with which the refrigerant portion that remains gaseous in separator 19 is combined, heated in heat exchangers 24, 7 and 22, and again compressed. A second part is subjected to pressure reduction in 26*b*, heated in the lower part of heat exchanger 23 and then combined upstream from heat exchanger 7 with the other low-pressure refrigerant.

To improve the energy balance of the process further, an intermediate fraction 28 is brought out, in the embodiment, from separation column 9, partially condensed in heat exchange 24 with refrigerant, and fed back via line 29 to separation column 9. Analogously, several such intermediate fractions can also removed at various points for partial condensation. This must be decided in the individual case based on weighing the higher expense in equipment, on the one hand, against the reduced energy losses, on the other.

The heat exchangers required in the embodiment are preferably produced as coiled equipment with pipes made of high-grade steel.

According to one aspect of the invention, the process works with a control device instead of a regulating device, as is otherwise usually done. To do this, the flow of the gas mixture to be separated in line 6 is measured (30). From this measured value, set points for the refrigeration requirement are found in a control unit 31 by means of additional parameters, which were calculated partly theoretically, partly based on experience, and then the flow in the refrigerant lines is adjusted. This manipulation is accomplished by controlling pressure-reduction valves 25, 26*a*, 26*b*.

The following numerical example relates to the separation of $C_4$ hydrocarbons from the product gas of $C_4$ dehydration. Because of the intermittent operation, the dehydration reactors alternate the throughput and composition of the product gas with an approximately four-minute period. For each content, two values are indicated: on the left for the phase of maximum throughput of the gas mixture to be separated (612 mol/s via line 6) and the associated smaller relative, but larger absolute hydrogen portion (about 55%, corresponds to 334 mol/s); on the right for minimum throughput (423 mol/s) and larger relative, but lower absolute hydrogen content (about 64%, corresponds to 275 mol/s).

The various streams, for which data are indicated in the table, are characterized by capital letters A to G. In detail, they mean:

A Feed gas before partial condensation (line 6)
B feed gas after partial condensation (line 8)
C bottom product (line 27)
D top fraction before partial condensation (line 10)
E top fraction after partial condensation (line 12)
F intermediate fraction before partial condensation (line 28)
G intermediate fraction after partial condensation (line 29)

In this special application, the refrigerant exhibits the following molar composition:

| | |
|---|---|
| $CH_4$ | 2% |
| $C_2H_4$ | 20% |
| $C_2H_6$ | 25% |
| Iso-$C_4H_{10}$ | 53% |

TABLE

| Site | Content/Component | at Maximum Load | at Minimum Load |
|---|---|---|---|
| A | $H_2$ | 54.6 mol % | 63.8 mol % |
| | $CH_4$ | 12.7 mol % | 3.8 mol % |
| | $C_2H_4$ | 0.9 mol % | 0.3 mol % |
| | $C_2H_6$ | 0.9 mol % | 0.4 mol % |
| | $C_3H_6$ | 6.9 mol % | 4.0 mol % |
| | $C_3H_8$ | 4.3 mol % | 4.9 mol % |
| | iso-$C_4H_{10}$ | 5.8 mol % | 8.5 mol % |
| | isobutene | 8.0 mol % | 6.2 mol % |
| | $C_4H_{10}$ | 0.1 mol % | 0.1 mol % |
| | 1-butene | 0.4 mol % | 0.3 mol % |
| | 1,2-butadiene | 0.05 mol % | 0.05 mol % |
| | $N_2$ | 4.0 mol % | 5.7 mol % |
| | CO | 0.9 mol % | 1.3 mol % |
| | $CO_2$ | 0.45 mol % | 0.6 mol % |
| | Pressure | 11.0 bar | 11.0 bar |
| | Temperature | 280.2 K. | 280.2 K. |
| B | Pressure | 10.7 bar | 10.7 bar |
| | Temperature | 243.2 K. | 243.2 K. |
| | Liquid Portion | 18.5% | 17.5% |
| C | $H_2$ | 0.5 mol % | 0.6 mol % |
| | $CH_4$ | 1.4 mol % | 0.4 mol % |
| | $C_2H_4$ | 0.6 mol % | 0.2 mol % |
| | $C_2H_6$ | 1.0 mol % | 0.4 mol % |
| | $C_3H_6$ | 21.6 mol % | 12.7 mol % |
| | $C_3H_8$ | 15.2 mol % | 18.2 mol % |
| | iso-$C_4H_{10}$ | 24.2 mol % | 37.5 mol % |
| | isobutene | 33.0 mol % | 27.5 mol % |
| | $C_4H_{10}$ | 0.4 mol % | 0.4 mol % |
| | 1-butene | 1.5 mol % | 1.5 mol % |
| | 1,2-butadiene | 0.2 mol % | 0.2 mol % |
| | $N_2$ | 0.1 mol % | 0.1 mol % |
| | CO | <0.01 mol % | <0.01 mol % |
| | $CO_2$ | 0.2 mol % | 0.3 mol % |
| | Pressure | 10.7 bar | 10.7 bar |
| | Temperature | 241.9 K. | 242.0 K. |
| D | $H_2$ | 67.9 mol % | 78.4 mol % |
| | $CH_4$ | 15.5 mol % | 4.6 mol % |
| | $C_2H_4$ | 1.1 mol % | 0.4 mol % |
| | $C_2H_6$ | 1.0 mol % | 0.5 mol % |
| | $C_3H_6$ | 5.4 mol % | 3.6 mol % |
| | $C_3H_8$ | 2.4 mol % | 3.1 mol % |
| | iso-$C_4H_{10}$ | 0.02 mol % | 0.03 mol % |
| | isobutene | <0.01 mol % | <0.01 mol % |
| | $C_4H_{10}$ | <0.01 mol % | <0.01 mol % |
| | 1-butene | <0.01 mol % | <0.01 mol % |
| | 1,2-butadiene | <0.01 mol % | <0.01 mol % |
| | $N_2$ | 5.0 mol % | 7.0 mol % |
| | CO | 1.1 mol % | 1.6 mol % |
| | $CO_2$ | 0.5 mol % | 0.8 mol % |
| | Pressure | 10.5 bar | 10.5 bar |
| | Temperature | 221.0 K. | 218.7 K. |
| E | Pressure | 10.4 bar | 10.4 bar |
| | Temperature | 203.3 K. | 198.9 K. |
| | Liquid Portion | 5.4% | 4.8% |
| F | $H_2$ | 65.5 mol % | 75.6 mol % |
| | $CH_4$ | 15.0 mol % | 4.4 mol % |
| | $C_2H_4$ | 1.0 mol % | 0.4 mol % |
| | $C_2H_6$ | 1.0 mol % | 0.4 mol % |
| | $C_3H_6$ | 6.9 mol % | 4.5 mol % |
| | $C_3H_8$ | 3.8 mol % | 5.0 mol % |
| | iso-$C_4H_{10}$ | 0.3 mol % | 0.4 mol % |
| | isobutene | 0.2 mol % | 0.2 mol % |

TABLE-continued

| Site | Content/Component | at Maximum Load | at Minimum Load |
|---|---|---|---|
| | $C_4H_{10}$ | <0.01 mol % | <0.01 mol % |
| | 1-butene | <0.01 mol % | <0.01 mol % |
| | 1,2-butadiene | <0.01 mol % | <0.01 mol % |
| | $N_2$ | 4.8 mol % | 6.7 mol % |
| | CO | 1.1 mol % | 1.5 mol % |
| | $CO_2$ | 0.5 mol % | 0.7 mol % |
| | Pressure | 10.6 bar | 10.6 bar |
| | Temperature | 232.0 K. | 231.7 K. |
| G | Pressure | 10.6 bars | 10.6 bars |
| | Temperature | 223.2 K. | 221.2 K. |
| | Liquid Portion | 3.6% | 3.6% |

The diagram of FIG. 2 shows another embodiment of the process of the invention, which also is used preferably for preparing a product gas from $C_3$ or $C_4$ dehydration. Process steps and devices corresponding to one another carry the same reference numbers in both drawings.

Dehydration product gas is brought in via line 1 and subjected to pretreatment similar to that of the process of FIG. 1 (cooling by means of external refrigeration in heat exchanger 2, phase separation in separator 3, removal of chlorine in HCl reactor 4, drying 5). The feed gas in line 6 is cooled in heat exchanger 7 and partially condensed. The two-phase mixture is fed in via line 8 above the bottom of separation column 9. At the bottom of the separation column, the desired higher hydrocarbons accumulate as bottom product, and they are drawn off via line 27 and heated in heat exchanger 7'. They are removed separately from the higher-boiling components already condensed out in the pretreatment in separator 3.

Line 10 conveys the top fraction of the separation column to a heat exchanger 11, in which the fraction is partially condensed. The two-phase mixture is conveyed via line 12 to a separator 13 located in the upper area of the separation column. The portion of the top fraction that remains gaseous is removed via a residual-gas line 14 and heated in heat exchanger 15 to approximately ambient temperature. This gas can be drawn off via line 16 (for example to regenerate dryer 5) and/or via line 17.

According to the invention, the cold required to condense the feed gas (heat exchanger 7) and top fraction (heat exchanger 11) is generated in a way similar to the process of FIG. 1 by a multicomponent-refrigerant circuit 18.

The gaseous portion of the compressed refrigerant introduced into refrigerant separator 19 (line 20) is condensed, to recover the extreme cold by indirect heat exchange 15 with portion 14 of the top fraction that remains gaseous, and is supercooled. This steam is then subjected to pressure reduction in flow-control valve 25 and brought into indirect heat exchange 11 with top fraction 10 from separation column 9.

Liquefied portion 21 of refrigerant from refrigerant separator 19 is supercooled in heat exchanger 7'. The supercooled liquid is subjected to pressure reduction in flow-control valve 26, combined with the refrigerant portion that remains gaseous in separator 19, heated in heat exchanger 7' and completely evaporated and then again compressed.

To reduce the investment costs of the unit, the intermediate cooling step represented in FIG. 1 was eliminated in the process of FIG. 2. Heat exchanger 7' is embodied as a plate heat exchanger in this variant. It combines the function of heat exchangers 7, 22 and 23 of FIG. 1.

Control in the process of FIG. 2 is accomplished in a way similar to that described above in FIG. 1. In this respect, measuring devices are provided for the flow of gas mixture (30) to be separated in line 6 and for the pressure of refrigerant (33) in line 20. The measured values are converted in a control unit 31 to set points for the refrigeration requirement. Then, the flow in the refrigerant lines (pressure-reduction valves 25, 26) is adjusted.

The numerical examples from the above table also apply to the variant of FIG. 2. The elimination of the intermediate cooling (heat exchanger 24 of FIG. 1) produces only slight changes in the parameters of the other streams.

I claim:

1. A process for separating higher-boiling hydrocarbons from a gas mixture containing said higher-boiling hydrocarbons and lower-boiling components by rectification, said process comprising:

partially condensing said gas mixture and feeding the partially condensed gas mixture to a separation column;

removing a bottom fraction, rich in said higher-boiling hydrocarbons, and a top fraction, rich in said lower-boiling components, from said separation column;

partially condensing said top fraction to form a condensate, and introducing said condensate as reflux to the top of said separation column;

wherein partial condensation of said gas mixture and partial condensation of said top fraction are achieved by indirect heat exchange with a multicomponent refrigerant conveyed in an external refrigeration circuit; and wherein said refrigerant is compressed and separated in said external refrigeration circuit into a gaseous refrigerant fraction and a liquid refrigerant fraction, said gaseous refrigerant fraction is cooled and condensed by indirect heat exchange with the portion of said top fraction that remains gaseous after said partial condensation of said top fraction and condensed gaseous refrigerant fraction is then subjected to said indirect heat exchange with said top fraction wherein said top fraction is partially condensed.

2. A process according to claim 1, further comprising removing an intermediate fraction from an intermediate point of said separation column, at least partially condensing said intermediate fraction by indirect heat exchange with said refrigerant, and returning the at least partially condensed intermediate fraction to said separation column.

3. A process according to claim 1, wherein the process is conducted using a time-variable throughput, a time-variable composition of said gas mixture, or both.

4. A process according to claim 3, wherein the throughput, the composition of said gas mixture, or both, is measured and the throughput of refrigerant in at least one of said indirect heat exchanges for partial condensation is adjusted on the basis of the measurement.

5. A process according to claim 1, wherein a heat exchanger having helically arranged pipes is used for said indirect heat exchange between said top fraction and said refrigerant wherein said top fraction is partially condensed.

6. A process according to claim 1, wherein a heat exchanger having helically arranged pipes is used for said indirect heat exchange between said gaseous refrigerant fraction and said portion of said top fraction that remains gaseous after said condensation of said top fraction.

7. A process according to claim 1, wherein a heat exchanger having helically arranged pipes is used for said indirect heat exchange between said gas mixture and said refrigerant.

8. A process according to claim 1, wherein a plate heat exchanger is used for said indirect heat exchange between said gas mixture to be separated and said refrigerant.

9. A process according to claim 8, wherein an aluminum-plate heat exchanger is used for said indirect heat exchange between said gas mixture and said refrigerant.

10. A process according to claim 2, wherein a heat changer having helically arranged pipes is used for said indirect heat exchange between said intermediate fraction and said refrigerant.

11. A process according to claim 2, wherein the process is conducted using a time-variable throughput, a time-variable composition of feed gas mixture to be separated, or both.

12. A process according to claim 11, wherein the throughput, the composition of said gas mixture, or both, is measured and the throughput of refrigerant in at least one of said indirect heat exchanges for partial condensation is adjusted on the basis of the measurement.

13. A process according to claim 2, wherein a heat exchanger having helically arranged pipes is used for said indirect heat exchange between said top fraction and said refrigerant wherein said top fraction is partially condensed.

14. A process according to claim 3, wherein a heat exchanger having helically arranged pipes is used for said indirect heat exchange between said top fraction and said refrigerant wherein said top fraction is partially condensed.

15. A process according to claim 4, wherein a heat exchanger having helically arranged pipes is used for said indirect heat exchange between said top fraction and said refrigerant wherein said top fraction is partially condensed.

16. A process according to claim 11, wherein a heat exchanger having helically arranged pipes is used for said indirect heat exchange between said top fraction and said refrigerant wherein said top fraction is partially condensed.

17. A process according to claim 12, wherein a heat exchanger having helically arranged pipes is used for said indirect heat exchange between said top fraction and said refrigerant wherein said top fraction is partially condensed.

18. A process according to claim 1, wherein said higher-boiling hydrocarbons are $C_{3+}/C_{4+}$ hydrocarbons and said lower boiling components comprise hydrogen and methane.

19. A process according to claim 1, wherein said multi-component refrigerant contains $CH_3$, $C_2H_4$, $C_2H_6$ and iso-$C_4H_{10}$.

20. A process according to claim 18, wherein said multi-component refrigerant contains $CH_3$, $C_2H_4$, $C_2H_6$ and iso-$C_4H_{10}$.

21. A process according to claim 1, wherein said gas mixture contains 30–70 mole % of said lower-boiling component.

22. A process according to claim 1, wherein 10–30 mole % of said gas mixture is condensed by said indirect heat exchange with said refrigerant.

23. A process according to claim 1, wherein, after said partial condensation of said top fraction to form said condensate, the partially condensed top fraction is conveyed to a separator from which said condensate is delivered to said separation column as reflux and said portion of said top fraction that remains gaseous is removed and subjected to said indirect heat exchange with said condensed gaseous refrigerant fraction.

24. A process according to claim 2, wherein said condensed gaseous refrigerant fraction, after being subjected to indirect heat exchange with said top fraction, is combined with a portion of said liquid refrigerant fraction and the resultant refrigerant fraction is subjected to said indirect heat exchange with said intermediate fraction wherein said intermediate fraction is at least partially condensed.

25. A process according to claim 24, wherein, after said indirect heat exchange with said intermediate fraction, said resultant refrigerant fraction is combined with a further portion of said liquid refrigerant fraction and the combined refrigerant stream is subjected to said indirect heat exchange with said gas mixture wherein said gas mixture is partially condensed.

26. A process according to claim 25, wherein, after said indirect heat exchange with said gas mixture, said combined refrigerant stream is subjected to indirect heat exchange with said liquid refrigerant fraction.

27. A process according to claim 1, wherein said liquid refrigerant fraction is subjected to indirect heat exchange with said bottom fraction.

28. A process according to claim 27, wherein a portion of said liquid refrigerant fraction, after undergoing said indirect heat exchange with said bottom fraction, is combined with said condensed gaseous refrigerant fraction at a point upstream of said indirect heat exchange between said top fraction and said condensed gaseous refrigerant fraction wherein said top fraction is partially condensed.

29. A process according to claim 2, wherein said condensed gaseous refrigerant fraction, after being subjected to said indirect heat exchange with said top fraction, is combined with a portion of said liquid refrigerant fraction and the resultant refrigerant fraction is subjected to said indirect heat exchange with said gas fraction and indirect heat exchange with said liquid refrigerant fraction.

30. A process for separating higher-boiling hydrocarbons from a gas mixture containing said higher-boiling hydrocarbons and lower-boiling components by rectification, said process comprising:

subjecting said gas mixture to indirect heat exchange whereby a portion of said gas mixture is condensed and feeding the resultant combined condensed and gaseous portions of said gas mixture to a separation column;

removing a bottom fraction, rich in said higher-boiling hydrocarbons, and a top fraction, rich in said lower-boiling components, from said separation column;

subjecting said top fraction to indirect heat exchange whereby a portion of said top fraction is condensed to form a condensate, and introducing said condensate as reflux to the top of said separation column;

wherein condensation of said portion of said gas mixture and condensation of said portion of said top fraction are achieved by indirect heat exchange with a multicomponent refrigerant conveyed in an external refrigeration circuit; and wherein said refrigerant is compressed and separated in said external refrigeration circuit into a gaseous refrigerant fraction and a liquid refrigerant fraction, said gaseous refrigerant fraction is cooled and condensed by indirect heat exchange with the portion of said top fraction that remains gaseous after said condensation of a portion of said top fraction and condensed gaseous refrigerant fraction is then subjected to said indirect heat exchange with said top fraction wherein a portion of maid top fraction is condensed.

31. A process according to claim 30, wherein, after condensation of said portion of said top fraction, said top fraction is conveyed to a separator from which said condensate is delivered to said separation column as reflux and said portion of said top fraction that remains gaseous is removed and subjected to said indirect heat exchange with said condensed gaseous refrigerant fraction.

* * * * *